US010971842B2

(12) United States Patent
Szyszko et al.

(10) Patent No.: US 10,971,842 B2
(45) Date of Patent: Apr. 6, 2021

(54) LOADBREAK ELECTRICAL CONNECTOR WITH ENHANCED SAFETY PROBE

(71) Applicant: ABB Schweiz AG, Baden (CH)

(72) Inventors: Stanley S. Szyszko, Wall, NJ (US); Daniel L. Gardner, Hickory, NC (US); William Longcor, IV, Newton, NJ (US); Elvan Ozdemir, Wayne, NJ (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/454,549

(22) Filed: Jun. 27, 2019

(65) Prior Publication Data

US 2020/0006879 A1 Jan. 2, 2020

Related U.S. Application Data

(60) Provisional application No. 62/690,593, filed on Jun. 27, 2018.

(51) Int. Cl.
*H01R 13/03* (2006.01)
*H01R 13/422* (2006.01)

(52) U.S. Cl.
CPC ..... *H01R 13/03* (2013.01); *H01R 13/422* (2013.01)

(58) Field of Classification Search
CPC ..... H01R 13/03; H01R 13/422; H01R 4/56; H01R 13/641; H01R 13/53; H01R 43/24
See application file for complete search history.

(56) References Cited

U.S. PATENT DOCUMENTS 3,539,972 A * 11/1970 Silva ..... H01H 9/085 439/185
6,168,447 B1 * 1/2001 Stepniak ..... H01R 13/53 439/187
6,939,151 B2 * 9/2005 Borgstrom ..... H01R 13/5216 439/187
6,984,791 B1 * 1/2006 Meyer ..... H01R 13/53 174/167
7,572,133 B2 * 8/2009 Hughes ..... H01H 33/66207 439/181
7,642,465 B2 * 1/2010 Meyer ..... H01R 13/641 174/167
8,056,226 B2 * 11/2011 Hughes ..... H01R 43/24 29/883
8,109,776 B2 * 2/2012 Hughes ..... H01R 13/504 439/282
2008/0261465 A1 * 10/2008 Hughes ..... H01R 13/53 439/889

* cited by examiner

*Primary Examiner* — Jean F Duverne
(74) *Attorney, Agent, or Firm* — Taft Stettinius & Hollister LLP

(57) ABSTRACT

A loadbreak electrical connector includes a connector body having first and second passages therewithin and a safety probe configured to be installed within the first passage. The safety probe includes a conductive probe body extending between first and second ends, the probe body having a probe aperture at the second end and a probe pin connected to the probe body via the probe aperture. The safety probe includes an arc quenching section located at a distal end of the probe pin and has a resistance section located between the second end of the probe body and the arc quenching section. The resistance section is made of a highly resistance material which reduces current flow through this section of the safety probe.

20 Claims, 2 Drawing Sheets

LOADBREAK ELECTRICAL CONNECTOR WITH ENHANCED SAFETY PROBE

CROSS REFERENCE TO RELATED APPLICATIONS

The present application claims the benefit of U.S. Provisional Patent Application Ser. No. 62/690,593, which was filed on Jun. 27, 2018, and is incorporated herein by reference in its entirety.

FIELD OF THE INVENTION

The present invention relates to loadbreak electrical connectors, and more particularly, to loadbreak electrical connectors with an improved safety probe to reduce a flashover to the ground.

BACKGROUND

Loadbreak electrical connectors are used for connecting and disconnecting underground cable to transformers, switching cabinets, and junctions equipped with loadbreak bushings. Each of these loadbreak electrical connectors has a probe, which normally has an arc quenching material molded onto a metal or fiberglass pin. This pin is inserted into a copper probe body and staked thereto. The arc quenching material can also be molded directly onto the end of the copper probe body. This arc quenching material reduces the amount of arcing and gases created when an arc is initiated between the probe body and a female contact of a bushing insert or a junction during a make or break operation. However, the probe used in these loadbreak electrical connectors has a high risk of a flashover to the ground and switching failures.

Accordingly, although various loadbreak electrical connectors are available currently in the marketplace, further improvements are possible.

SUMMARY

According to an embodiment of the present invention, a loadbreak electrical connector includes a conductive connector body having first and second passages therewithin and a safety probe configured to be installed within the first passage. The safety probe includes a probe body extending between first and second ends, the probe body having a probe aperture at the second end and a probe pin connected to the probe body via the probe aperture. The safety probe includes an arc quenching section located at a distal end of the probe pin and has a resistance section located between the second end of the probe body and the arc quenching section. The resistance section acts as a resistor to reduce current flow in this section of the safety probe prior to contact with the conductive section or arc quenching section during load make or break operations.

According to another embodiment of the present invention, a loadbreak electrical connector includes a connector body having first and second passages therewithin and a safety probe extending between first and second ends, the safety probe having an arc quenching section and a resistance section. The arc quenching section is located at the second end of the safety probe, and the resistance section is located between the conductive connector body and the arc quenching section.

These and other aspects of the present invention will be better understood in view of the drawings and following detailed description.

DETAILED DESCRIPTION

Figure 1:
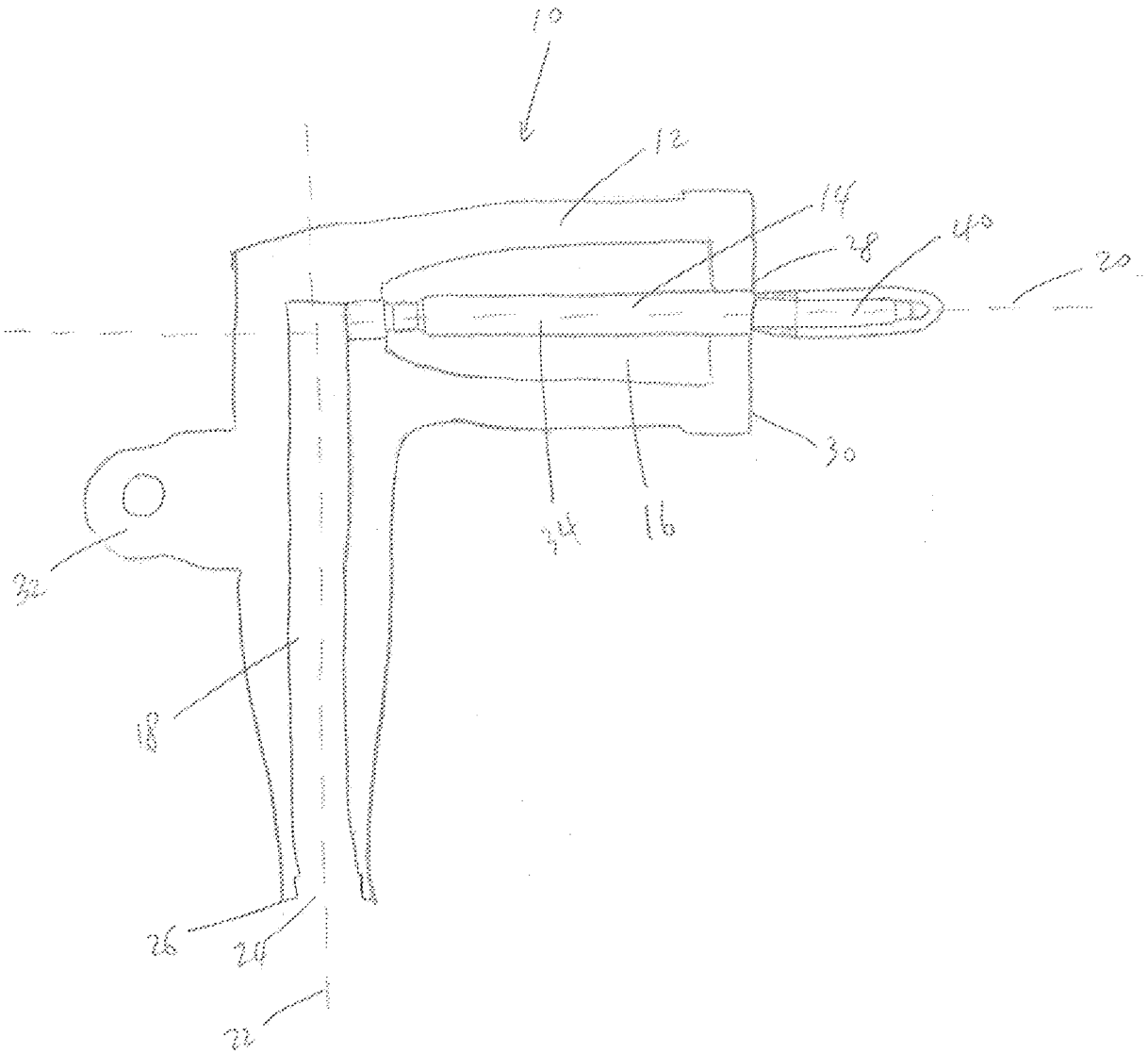
FIG. 1 is a cross-sectional view of a loadbreak electrical connector, according to an embodiment of the present invention.

According to an embodiment of the present invention, referring to FIG. 1, there is shown a loadbreak electrical connector 10 configured to be used for high voltage power distribution equipment. The loadbreak electrical connector 10 includes a connector body 12 and a safety probe 14 adapted to be installed within the connector body 12. The safety probe 14 is designed and configured to reduce current during make, break, or fault close operation, as will be described in greater detail below.

Referring again to FIG. 1, the connector body 12 defines an elbow 17 and includes a first passage 16 and a second passage 18. The first and second passages 16, 18 extend along a horizontal axis 20 of the connector body 12 and a vertical axis 22 of the connector body 12, respectively, such that the first and second passages 16, 18 are substantially perpendicular and intersect each other. A cable connector opening 24 is defined and located at a distal end 26 of the second passage 18 for receiving a cable (not shown) therethrough. When a cable with a cable connector (not shown) is inserted into the second passage 18 via the cable connector opening 24 of the connector body 12, the cable opening of the cable connector is aligned with the horizontal axis 20 of the connector body 12. In addition, a bushing connector opening 28 is defined and located at a distal end 30 of the first passage 16 for receiving and engaging with a bushing (not shown).

The loadbreak electrical connector 10 can also include a pulling eye 32 on the connector body 12 to act as a handle for the loadbreak electrical connector 10. The pulling eye 32 is used to install or uninstall the loadbreak electrical connector 10 on a power distribution equipment. The pulling eye 32 is also used to adjust the position of the loadbreak electrical connector 10 once installed.

Figure 2:
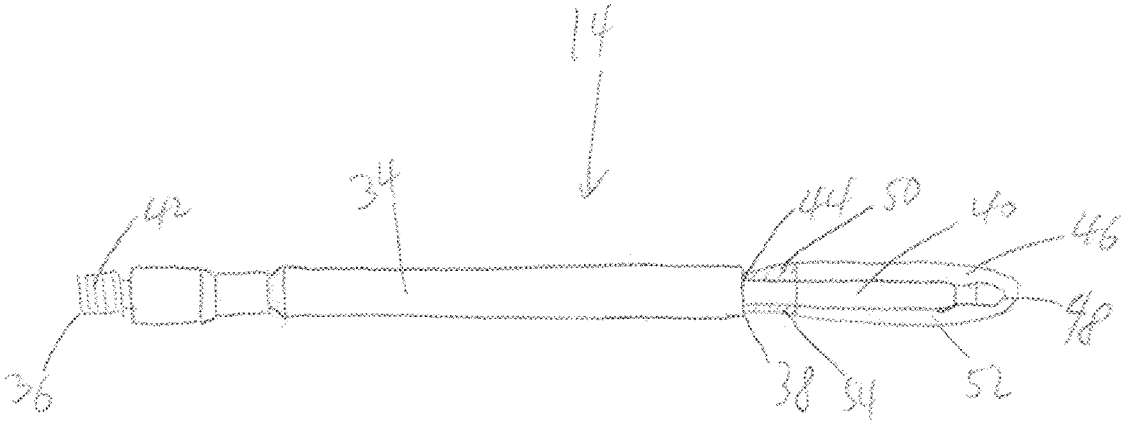
FIG. 2 is a perspective view of the safety probe in FIG. 1.

Referring to FIG. 2, there is shown the safety probe 14 configured to be installed within the first passage 16 of the connector body 12 via inserting it through the bushing connector opening 28. The safety probe 14 has a generally elongated cylindrical shape and includes a probe body 34 extending between first and second ends 36, 38, and a probe pin 40. Once the safety probe 14 is inserted through the bushing connector opening 28 and into the first passage 16, the safety probe 14 could be installed therewithin by engaging a threaded portion 42 of the safety probe 14, formed at the first end 36 of the probe body 34, with the cable opening of the cable connector. A probe aperture 44 is defined at the second end 38 of the probe body 34, through which the probe pin 40 is inserted and connected thereto. The probe aperture 44 is configured and dimensioned to closely accommodate the probe pin 40 therewithin.

Referring again to FIG. 2, the probe pin 14 includes an arc quenching section 46 at a distal end 48 of the probe pin 40 and a resistance section 50 adjacent to the arc quenching section 46 such that it is located between the second end 38 of the probe body 34 and the arc quenching section 46. In the arc quenching section 46, an arc quenching material 52 is molded onto the probe pin 40 to provide insulation during make or break operation. Specifically, the arc quenching material 52 reduces the amount of arcing and gases produced when an arc is initiated between the probe body 34 and the bushing.

In the resistance section 50, a high resistance material 54 is molded onto the probe pin 40 to act as a resistor for reducing the current during make, break, or fault close operation. Specifically, the resistance section 50 reduces the amount of current that can be transferred once a contact is made between the resistance section 50 of the safety probe 14 and a bushing insert (not shown) of the bushing, thereby preventing the bushing insert from heating, melting, and flashing to the ground. Upon removing the safety probe 14 from an energized bushing insert, the contact area first moves from the conductive portion of the probe body 34 to the resistance section 50. At this contact point, the resistance section 50 reduces the current before contact with the arc quenching section 46. In this way, by first reducing the current, the potential for arcing is also reduced. Once the bushing insert slides along the length of the resistance section 50 and contacts the probe body 34 of the safety probe 14, the amount of current increases. In addition, the loadbreak electrical connector 10 is inserted into the busing insert with one quick motion, and the safety probe 14 reduces the amount of switching failures.

The connector body 12 of the loadbreak electrical connector 10 and the safety probe 14 are made of one or more materials having suitable properties for a desired application, including strength, weight, rigidity, etc. Copper is highly preferred for the probe body 34 of the safety probe 14. In addition, molybdenum or high-K rubber is highly preferred for the resistance material 54.

Figure 3:
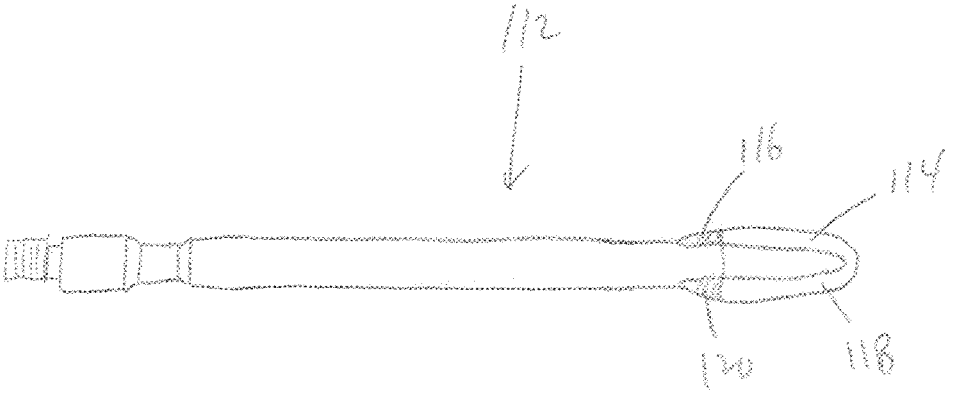
FIG. 3 is a perspective view of another embodiment of the safety probe in FIG. 1.

Referring to FIG. 3, in an alternate embodiment, a safety probe 112 for the loadbreak electrical connector 10 is similar to the safety probe 14 described above except that the safety probe 112 has a one-piece structure and is configured without a safety pin. Accordingly, in the depicted embodiment, an arc quenching section 114 is located at one end of the safety probe 112, with a resistance section 116 adjacent to the arc quenching section 114. Thus, an arc quenching material 118 and a resistance material 120 are molded directly onto the safety probe 112.

The present invention is also directed to a method of reducing arcing upon a load make or break operation by the safety probe 14 discussed above. The method includes having a resistance section 50 on the safety probe 14 located between the conductive probe body 34 and arc quenching section 46. When inserting the safety probe 14 in a load making operation, the energized portion of the bushing first contacts the arc quenching section 46 and next contacts the resistance section 50 which, having a high resistance material, reduces the value of the current for the time period in which there is contact with the resistance section 50 of the safety probe 14. Once contact is made with the conductive body 34, full current is free to flow through the connector.

When making a load break operation, as discussed above, the contact area moves from the conductive body 34 at full current, over the resistance section 50 which reduces the current before contacting the arc quenching section 46.

It will be appreciated that other designs and configurations could be used for the loadbreak electrical connector 10 and the safety probe 14, 112, as deemed suitable for given application factors. For example, the loadbreak electrical connector 10 and the safety probe 14, 112 may be designed and configured in a T-shape and an elongated rectangular shape, respectively.

From the foregoing, it will be appreciated that a loadbreak electrical connector according to the present invention includes an enhanced safety probe to provide a use for high voltage power distribution equipment.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A loadbreak electrical connector comprising:

a connector body having first and second passages therewithin; and a safety probe configured to be installed within the first passage, the safety probe including:

a probe body extending between first and second ends, the probe body having a probe aperture at the second end; and a probe pin connected to the probe body via the probe aperture;

wherein the safety probe includes an arc quenching section formed of an arc quenching material, the arc quenching section located at a distal end of the probe pin and has a resistance section located between the second end of the probe body and the arc quenching section, and wherein the resistance section is formed of a high resistance material which reduces current through this section of the safety probe during make, break, or fault close operation, the resistance material being different than the arc quenching material.

2. The loadbreak electrical connector of claim 1, wherein the resistance material is molded onto the probe pin.

3. The loadbreak electrical connector of claim 2, wherein the resistance material is molybdenum or high-K rubber.

4. The loadbreak electrical connector of claim 1, wherein the arc quenching material is molded onto the probe pin.

5. The loadbreak electrical connector of claim 1, wherein the probe body of the safety probe is made out of copper.

6. The loadbreak electrical connector of claim 1, wherein the resistance material is in the form of a coating applied to probe.

7. The loadbreak electrical connector of claim 1, wherein the first and second passages extend along a horizontal axis of the connector body and a vertical axis of the connector body, respectively, such that the first and second passages are substantially perpendicular and intersect each other.

8. The loadbreak electrical connector of claim 1, wherein a bushing connector opening is defined at a distal end of the first passage for receiving and engaging with a bushing.

9. The loadbreak electrical connector of claim 1, wherein a cable connector opening is defined at a distal end of the second passage for receiving a cable therethrough.

10. The loadbreak electrical connector of claim 1, wherein the safety probe has a generally elongated cylindrical shape.

11. A loadbreak electrical connector comprising:

a connector body having first and second passages therewithin; and a safety probe extending between first and second ends, the safety probe having a conductive section, an arc quenching section and a resistance section, the arc quenching section comprising an arc quenching material, and the resistance section comprising a resistance material that is different than the arc quenching material;

wherein the arc quenching section is located at the second end of the safety probe, and the resistance section is located between the conductive section and the arc quenching section, and wherein the resistance section reduces current through the safety probe during make, break, or fault close operation.

12. The loadbreak electrical connector of claim 11, wherein the resistance material is molded onto the safety probe.

13. The loadbreak electrical connector of claim 12, wherein the resistance material is molybdenum or high-K rubber.

14. The loadbreak electrical connector of claim 11, wherein arc quenching material is molded onto the probe pin.

15. The loadbreak electrical connector of claim 11, wherein the safety probe is made out of copper.

16. The loadbreak electrical connector of claim 11, wherein the first and second passages extend along a horizontal axis of the connector body and a vertical axis of the connector body, respectively, such that the first and second passages are substantially perpendicular and intersect each other.

17. The loadbreak electrical connector of claim 11, wherein a bushing connector opening is defined and located at a distal end of the first passage for receiving and engaging with a bushing.

18. The loadbreak electrical connector of claim 11, wherein a cable connector opening is defined and located at a distal end of the second passage for receiving a cable therethrough.

19. The loadbreak electrical connector of claim 11, wherein the safety probe has a generally elongated cylindrical shape.

20. A method of reducing arcing during load make, break, or fault close operation comprising the steps of:

providing a safety probe in an electrical connector, the safety probe including a conductive section, a resistance section, and an arc quenching section, the resistance section comprising a resistance material and being located between the conductive section and the arc quenching section, the arc quenching section comprising an arc quenching material different than the resistance material; and moving the safety probe relative to an energized conductor so that contact is made with the resistance section which reduces current prior to contacting the conductive section or arc quenching section thereby reducing the risk of flashover or arcing.

* * * * *